United States Patent [19]

Rohner

[11] 4,202,506

[45] May 13, 1980

[54] DEVICE FOR MONITORING THREAD TRAVEL

[75] Inventor: Joachim Rohner, Mönchen-Gladbach, Fed. Rep. of Germany

[73] Assignee: W. Schlafhorst & Co., Mönchen-Gladbach, Fed. Rep. of Germany

[21] Appl. No.: 927,964

[22] Filed: Jul. 26, 1978

Related U.S. Application Data

[63] Continuation of Ser. No. 792,865, May 2, 1977, abandoned.

[30] Foreign Application Priority Data

May 3, 1976 [DE] Fed. Rep. of Germany ..... 2619430

[51] Int. Cl.[2] ..... B65H 63/02

[52] U.S. Cl. ..... 242/36; 57/87; 242/37 R

[58] Field of Search ..... 242/36, 37 R, 38, 49, 242/28, 29, 35.5 R, 35.6 R; 28/222, 223, 225, 226, 227; 57/80, 81, 86, 87

[56] References Cited

U.S. PATENT DOCUMENTS

| | | | |
|---|---|---|---|
| 3,165,275 | 1/1965 | Furst | 242/35.6 R |
| 3,198,446 | 8/1965 | Furst et al. | 242/35.6 R |
| 3,511,448 | 5/1970 | Brouwer et al. | 242/36 |
| 3,734,422 | 5/1973 | Loepfe | 242/36 |
| 3,756,524 | 9/1973 | Felix | 242/36 |
| 3,844,498 | 10/1974 | Loepfe | 242/36 |
| 3,929,297 | 12/1975 | Zumfeld et al. | 242/36 |
| 4,010,908 | 3/1977 | Patterson | 242/36 |

FOREIGN PATENT DOCUMENTS

| | | | |
|---|---|---|---|
| 748110 | 12/1966 | Canada | 242/36 |

*Primary Examiner*—Stanley N. Gilreath
*Attorney, Agent, or Firm*—Herbert L. Lerner

[57] ABSTRACT

Device for monitoring thread travel in a winding device of a textile machine having, disposed in the travel path of the thread, a thread guiding member for a take-up coil, including a thread monitoring device disposed in the thread travel path upstream of the thread guiding member, the thread monitoring device having means for producing a noise signal when a thread is travelling along the path, a high-speed thread clamping device disposed adjacent the thread travel path, and means responsive to a discontinuance of the noise signal for actuating the high-speed thread clamping device to grip a thread present in the travel path.

5 Claims, 3 Drawing Figures

DEVICE FOR MONITORING THREAD TRAVEL

This is a continuation of application Ser. No. 792,865, filed May 2, 1977, now abandoned.

The invention relates to a device for monitoring thread travel and, more particularly, for monitoring thread travel in a winding device of a textile machine having, disposed in the travel path of the thread, a thread guiding member for a take-up coil, and a thread monitoring device, in the travel path upstream of the thread guiding member, for evaluating noise signals from the travelling thread.

Such devices are employed, for example, for stopping the winding device if the noise signal stops because the thread has been broken or the supply coil has run out or been emptied.

If a thread break should occur, however, in the vicinity of the thread guiding member, the winding cylinder or the take-up coil, the noise signal remains off, in some cases, only for an interval of from 140 to 1,000 milliseconds and then starts up again, because the end of the oncoming thread hooks on again firmly to the thread guiding member, the winding cylinder or the take-up coil, and the winding operation resumes. Either an undesired winding on the thread guiding member or the winding cylinder occurs at that time or the take-up coil is, in fact, further wound, notwithstanding the fact that the thread of the winding has a break in it. These disturbing conditions can occur because, for example, the reaction time of the mechanically operating stopping or shut-off devices is longer than the period of interruption of the noise signal, or the machine is switched on again due to the renewed noise signal. Even if the winding device should however come to a stop yet thereafter, the faulty winding will have already occurred and must be removed or is not recognized or detected as such.

It is accordingly an object of the invention to provide a device for monitoring thread travel in a winding device, wherein further winding of a thread, after a break in the thread has occurred in the vicinity of the thread guiding member, the winding cylinder or the take-up coil, is prevented.

With the foregoing and other objects in view, there is provided, in accordance with the invention, a device for monitoring thread travel in a winding device of a textile machine having, disposed in the travel path of the thread a thread guiding member for a take-up coil, comprising a thread monitoring device disposed in the thread travel path upstream of the thread guiding member, the thread monitoring device having means for producing a noise signal when a thread is travelling along the path, a high-speed thread clamping device disposed adjacent the thread travel path, and means responsive to a discontinuance of the noise signal for actuating the high-speed thread clamping device to grip a thread present in the travel path.

Due to the high-speed clamping of the thread, the noise signal cannot start up again. The thread end located above the clamping location can be sucked in by a gripper nozzle and also held fast therein. A stopping or shut-off device for the winding device, released or activated by the interruption of the noise signal, begins to function reliably before the formation of any faulty winding. The formation of any cylinder-winding or further winding of the take-up coil is prevented. The high-speed clamping device also prevents the development of so-called run-out or run-down windings that could heretofore, have been formed because of the unavoidable machine run-down per se after the response of the stopping or shut-off devices.

In accordance with another feature of the invention, the high-speed thread clamping device comprises a spring-loaded member formed with a thread clamping surface, and electromagnetic actuating means for actuating the member so as to clamp a thread against the surface.

This feature of the invention contributes to keeping the reaction time of the high-speed clamping device to a minimum.

In accordance with a further feature of the invention, the thread-travel monitoring device comprises a high-speed thread clamping device having a thread clamping surface pressable against a thread, an electromagnet actuatable for pressing the thread clamping surface against a thread and relay means actuatable in response to the absence of a thread at a given location of the thread travel path for activating the electromagnet.

In accordance with a concomitant feature of the invention, the relay means comprise a normally closed relay openable in response to the absence of a thread, and the device of the invention further includes means for blocking reclosing of the relay. Thus, a rapid, self-retaining or self-holding clamping of the thread is obtained.

Other features which are considered as characteristic for the invention are set forth in the appended claims.

Although the invention is illustrated and described herein as embodied in device for monitoring thread travel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
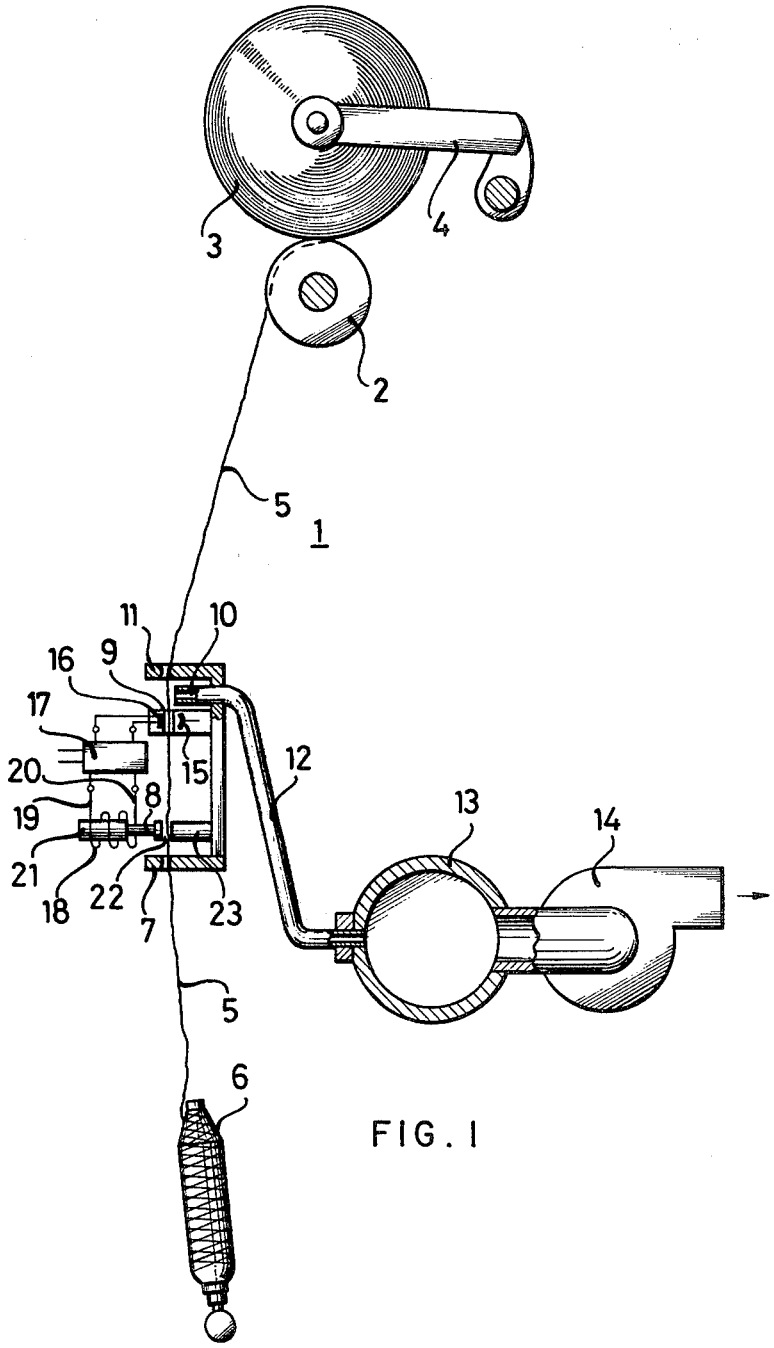
FIG. 1 is a diagrammatic view of the device for monitoring thread travel in accordance with the invention.

Referring now to the figures of the drawing, there is shown therein a winding station 1 of a yarn or thread-winding machine having a rotating grooved thread guiding and traversing cylinder 2 and a take-up coil 3 that is frictionally driven by the thread guiding cylinder 2. The take-up coil 3 is held by a coil frame 4. The thread 5 that is to be wound on the take-up coil 3 is withdrawn from a supply coil or cop 6, passed through a thread guiding eye 7, through an open high-speed thread clamping device 8 and a thread monitoring device 9, past a gripper nozzle 10 and, after passing another thread guiding eye 11, is guided over the grooved thread guiding cylinder 2 to the take-up coil 3.

Figure 2:
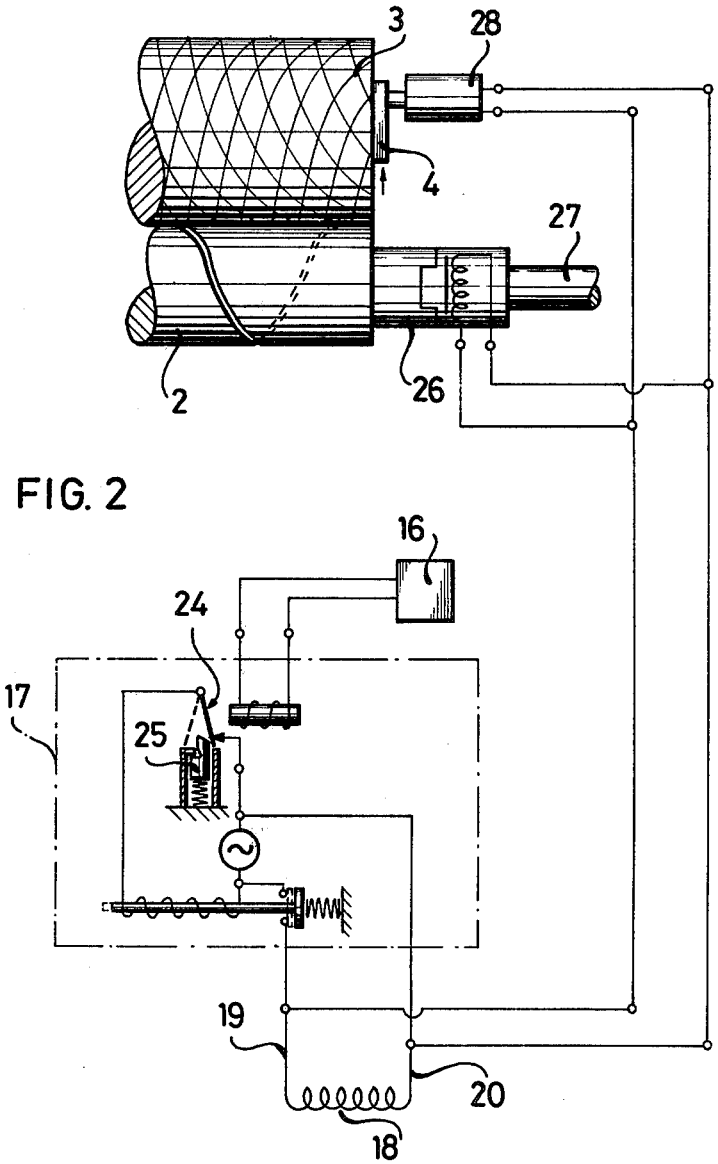
FIG. 2 is a circuit diagram of the electric switching station of FIG. 1, and equipment associated therewith

The thread monitoring device 9 has a luminous diode 15 which emits invisible, high-frequency infra-red light. The thread 5 is passed between the luminous diode 15 and an infra-red receiver 16 which is connected to an electric switching station or switch-gear 17. The light emitted by the luminous diode 15 is modulated by the irregular, rough surface of the thread 5. The modulation is manifested as a noise signal. As long as the noise signal persists, a steady-current or closed-circuit relay 24 (FIG. 2) located in the electric switching station 17 remains in switched-on condition. The instant the noise signal stops, the relay 24 switches off. A reclosing lock-out 25 prevents the relay 24 from switching on again. When the relay 24 switches off, a circuit of an electromagnet 18, which is connected to the electric switching circuit 17 through lines 19 and 20, is closed. An armature 21 of the electromagnet 18 is drawn toward the right-hand side, as viewed in the figure, so that the thread-clamping surface 22 is pressed against the thread 5 and against a counter-bearing 23. The electric switching circuit 17 can simultaneously effect the stoppage of the thread guiding cylinder 2 and the lifting of the take-up coil 3 with the coil holder 4 by suitable conventional means well within the knowledge of an individual of ordinary skill in the art. As shown diagrammatically in FIG. 2, a clutch 26 by which the thread guiding cylinder 2 is engaged with the main transmission shaft 27 of the winding machine, is disengaged, and a motor 28 is activated to raise the take-up coil holder 4.

Since the thread 5 is gripped by the thread clamping surface 22 against the counter-bearing 23 with an unavoidable delay time of 12 to 15 milliseconds counting from the instant the noise signal has stopped, the firm hooking of the oncoming thread end of the broken thread 5 to the thread guiding cylinder 2 or to the take-up coil 3 is no longer possible. The thread end no longer finds any time to dispose itself in several windings for example about the thread guiding cylinder 2, so that the entire thread end is sucked into a suction or negative-pressure container 13 by the gripper nozzle 10. The duration of 140 to 1,000 milliseconds of the thread stoppage occurring after the thread break is considerably greater than the response time of the high-speed thread clamping device 8. The possibility therefore also exists of delaying the response of the relay up to about 70 milliseconds after the noise signal has stopped. If the noise signal returns within this time interval, the cause of the stoppage thereof was then no thread break, but rather, the presence of a very uniform thread signal, a so-called "noise hole".

The details of the cooperation between the thread monitoring device 9, the electric switching station 17 and a relay are well-known so that it is believed to be unnecessary to go into any further detail herein with respect to switching technology. If the electromagnet 18, deviating from the hereinfore described illustrated representation thereof, is solely used for releasing a spring-loaded thread clamping surface, a reclosing lock-out of the relay is superfluous.

Figure 3:
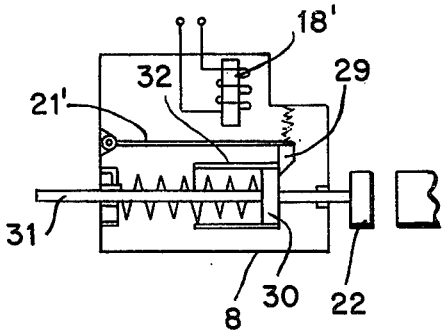
FIG. 3 is a diagrammatic view of an alternative embodiment of the high-speed thread clamping device of the invention.

Such an alternative embodiment is shown in the high-speed clamping device 8 of FIG. 3. When the electromagnet 18' is activated by the switching circuit 17 through the lines 19, 20, the armature 21' is attracted and swings upward against the small spring. The locking bar 29 which is attached to the armature 21' therefore releases the disc 30 on the rod 31 and the larger spring pushes the rod 31 and the thread-clamping surface 22 to the right, gripping the thread against the opposing counter-bearing. When the electromagnet 18' is deactivated, the locking bar 21 remains on the shell 32 which is connected to the disc 30, until the rod 31 is retracted by hand and the locking bar is again engaged behind the disc 30.

The advantages attained by the thread-travel monitoring device according to the invention are especially that faulty windings, especially also the heretofore not readily recognizable or discernible faulty windings produced after a thread break in the vicinity of the thread guiding member of the take-up coil, are prevented.

There are claimed:

1. Device for monitoring thread travel in a winding device of a textile machine having, disposed in the travel path of the thread from a thread supply, a thread guiding member for a take-up coil, comprising a thread monitoring device disposed in the thread travel path upstream of the thread guiding member, said thread monitoring device having means for producing a noise signal when a thread is travelling along the path, a high-speed thread clamping device disposed adjacent the thread travel path upstream of said monitoring device along the path, means responsive to a discontinuance of the noise signal for actuating said high-speed thead clamping device to grip a thread present in the travel path, and means adjacent and downstream of said monitoring device along the path for gripping an oncoming thread end from the thread supply present in the path.

2. Device according to claim 1 wherein said high-speed thread clamping device comprises a spring-loaded member formed with a thread clamping surface, and electromagnetic actuating means for actuating said member so as to clamp a thread against said surface.

3. Device according to claim 1 comprising a high-speed thread clamping device having a thread clamping surface pressable against a thread, an electromagnet actuatable for pressing said thread clamping surface against a thread, and relay means actuatable in response to the absence of a thread at a given location of said thread travel path for activating said electromagnet.

4. Device according to claim 3 wherein said relay means comprise a normally closed relay openable in response to said absence of a thread, and including means for blocking reclosing of said relay.

5. Device according to claim 1 wherein said high-speed clamping device clamps the oncoming thread before said gripping means grips the oncoming thread end.

* * * * *